US011849785B2

(12) United States Patent
Winans

(10) Patent No.: US 11,849,785 B2
(45) Date of Patent: Dec. 26, 2023

(54) GLOVE AND MIRROR

(71) Applicant: Benjamin Winans, Brentwood, TN (US)

(72) Inventor: Benjamin Winans, Brentwood, TN (US)

( * ) Notice: Subject to any disclaimer, the term of this patent is extended or adjusted under 35 U.S.C. 154(b) by 0 days.

(21) Appl. No.: 17/347,438

(22) Filed: Jun. 14, 2021

(65) Prior Publication Data

US 2022/0395038 A1 Dec. 15, 2022

(51) Int. Cl.
*A41D 19/00* (2006.01)

(52) U.S. Cl.
CPC ..... *A41D 19/0024* (2013.01); *A41D 19/0037* (2013.01)

(58) Field of Classification Search
CPC ..... A41D 19/0024; A41D 19/0037
See application file for complete search history.

(56) References Cited

U.S. PATENT DOCUMENTS 1,612,055 A * 12/1926 Rice ..... A41D 19/002 2/160
2,227,707 A * 1/1941 Cooper ..... A46B 5/04 119/633
2,745,128 A * 5/1956 Zeuner ..... A47K 7/02 15/244.1
3,643,386 A * 2/1972 Grzyll ..... A47L 17/08 451/523
3,857,133 A * 12/1974 Linenfelser ..... A47L 13/16 428/196
4,593,427 A * 6/1986 Ortolivo ..... A47L 13/19 451/523
4,863,239 A * 9/1989 Malone ..... G02B 7/182 2/160
5,694,261 A * 12/1997 Deal ..... B63C 11/02 2/DIG. 8
6,018,837 A * 2/2000 Andreu ..... A47K 7/02 15/118
6,367,116 B1 * 4/2002 DeBartolo ..... A41D 19/01594 2/160
6,460,190 B1 * 10/2002 Blum ..... A47L 17/06 2/160
6,513,998 B1 * 2/2003 Barry ..... A41D 19/0079 401/196
7,210,171 B2 * 5/2007 Jacobs ..... A47L 13/18 2/160
7,716,751 B2 * 5/2010 Cook ..... A41D 19/01529 2/163
D640,446 S * 6/2011 Allen ..... D2/614
8,069,526 B2 * 12/2011 Malaska ..... A47L 13/18 15/118
8,083,360 B2 * 12/2011 Bartlett ..... A45D 42/12 359/879
8,291,516 B2 * 10/2012 Chen ..... A41D 19/0024 2/160

(Continued)

FOREIGN PATENT DOCUMENTS

CN 2925151 Y 6/2006
CN 2925151 Y * 7/2007

*Primary Examiner* — Richale L Quinn

(57) ABSTRACT

A glove includes a main body that defines an interior space that is operable to receive at least a portion of a hand of the wearer. The glove includes a palm area with upper, lower, interior, and anterior limits. A mirror is provided on the palm area of the glove.

20 Claims, 7 Drawing Sheets

(56) References Cited

U.S. PATENT DOCUMENTS

| | | | | |
|---|---|---|---|---|
| 8,485,681 | B2 * | 7/2013 | Richter | A41D 19/0157 362/276 |
| D730,004 | S * | 5/2015 | Hutton | D32/43 |
| 9,320,309 | B2 * | 4/2016 | Morris | A41D 19/002 |
| 9,635,992 | B2 * | 5/2017 | Redd | A47L 13/18 |
| 2005/0034212 | A1 * | 2/2005 | Eisenbraun | A41D 19/0027 2/159 |
| 2006/0007669 | A1 * | 1/2006 | Blackburn | A41D 19/0157 362/103 |
| 2008/0259477 | A1 * | 10/2008 | Gorton | A45F 5/02 359/879 |
| 2010/0033858 | A1 * | 2/2010 | Weech | G02B 7/002 359/879 |
| 2011/0258753 | A1 * | 10/2011 | Jacque | A41D 19/0024 2/160 |
| 2015/0047096 | A1 * | 2/2015 | Smith | A41D 19/002 2/160 |
| 2015/0245677 | A1 * | 9/2015 | Jacque | A41D 19/0157 2/160 |
| 2017/0086521 | A1 * | 3/2017 | Sterner | F21V 23/002 |
| 2017/0340034 | A1 * | 11/2017 | Jacque | A41D 19/0024 |
| 2017/0363258 | A1 * | 12/2017 | Tolley | F21V 23/0442 |

* cited by examiner

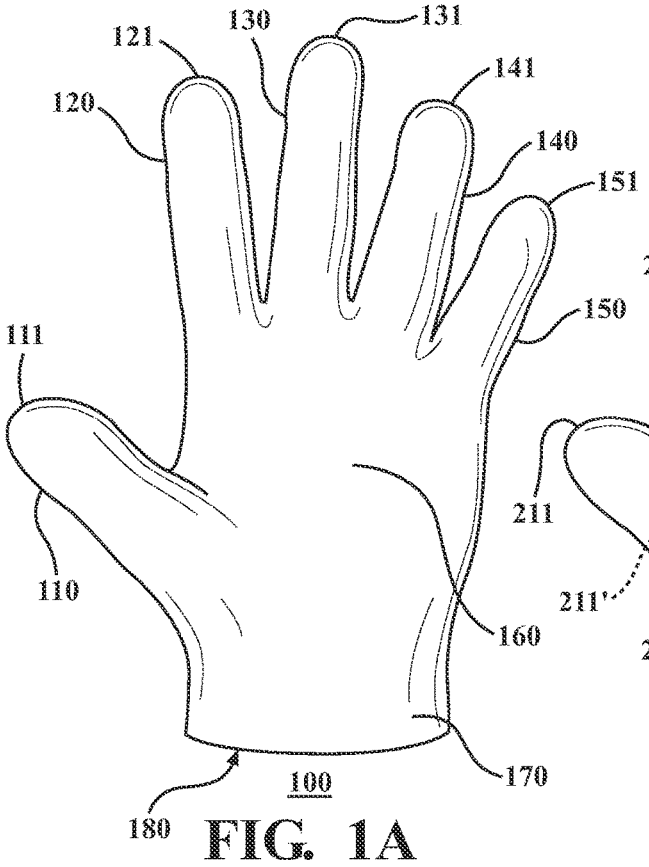
FIG. 1A
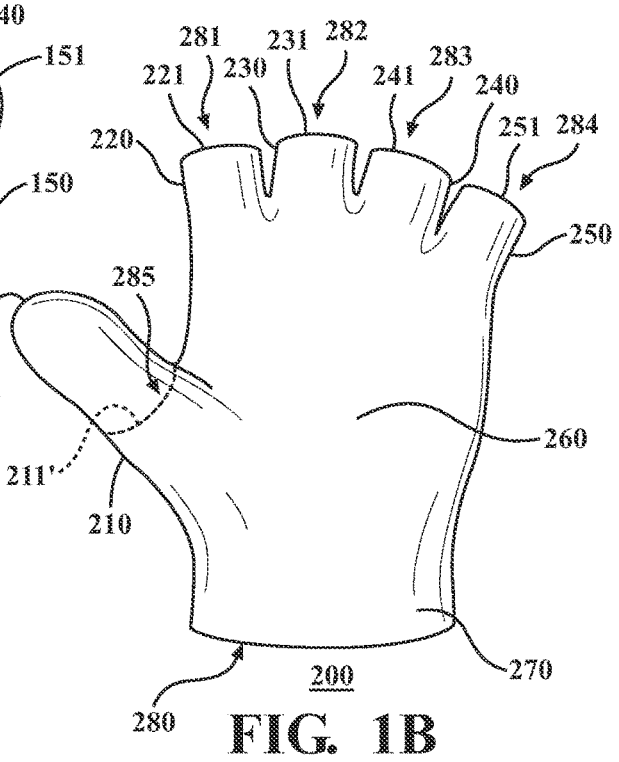
FIG. 1B
FIG. 1C
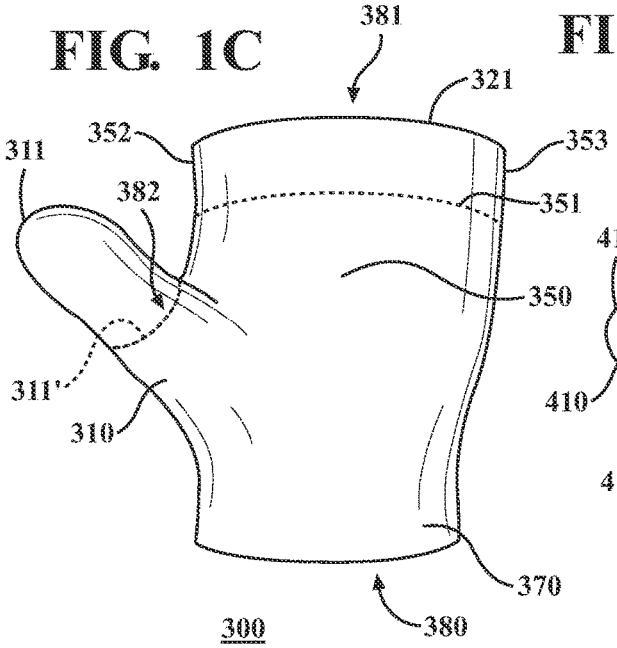
FIG. 1D
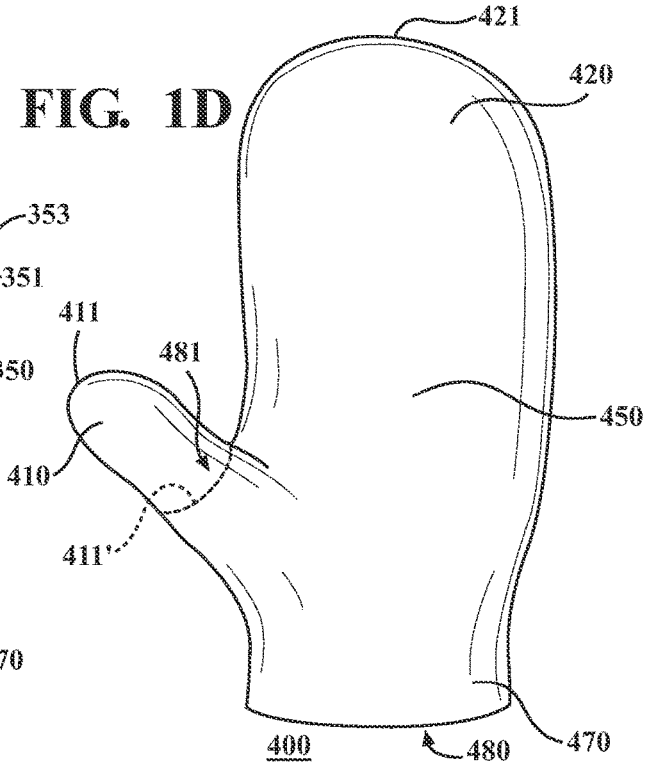

GLOVE AND MIRROR

FIELD

The present disclosure relates to a glove and, more particularly, to a glove configured with a mirror on it.

BACKGROUND

This section provides background information related to the present disclosure which is not necessarily prior art.

There are several types of gloves for a wide variety of uses. For instance, many athletes wear gloves when participating in certain sports activities. Baseball players, for example, wear batting gloves when at-bat to improve the grip on the bat and to thereby improve batting performance. Golfers wear similar gloves to improve the grip on the golf club. Other athletes wear gloves for other reasons as well (e.g., to maintain warm hands, impact protection, etc.). In other instances, gloves may be worn by workers when performing certain tasks to avoid damage to their hands (e.g., in the form of blisters, cuts, etc.), or to keep them from getting dirty, or for other reasons which may be similar or different to why athletes wear gloves.

Some gloves designed for specific activities may have mirrors integrated so as to enable a wearer to see what is behind them when, e.g., they are cycling or motorcycling. Commercially available gloves with integrated mirrors locate such mirrors on the rear of the hand, since they are specifically intended for use by cyclists and motorcyclists, and this mounting configuration provides optimal utility when gripping a handlebar.

Certain activities do not require continuous grasping of an object (e.g., a handlebar) and require movements that make it uncomfortable or inefficient to look at a mirror located on the back of the hand. Further, when a wearer is performing certain movements, a mirror that is constantly within the wearer's line of sight may result in distracting or harmful reflections, for example from the sun or other light sources. A mirror positioned on the back of the hand provides suffers from this disadvantage. Runners may especially benefit from a glove with an integrated mirror to enable them to see what is behind them when needed but does not distract them when they are running. A glove capable of providing a rear view to runners who wear it would provide added safety when running.

SUMMARY

This section provides a general summary of the disclosure and is not a comprehensive disclosure of its full scope or all of its features.

A glove is disclosed that is operable to be worn on a hand of a wearer. The glove includes a main body that defines an interior space that is operable to receive at least a portion of the hand of the wearer. The main body includes a back area and a palm area, and a mirror is disposed on the palm area.

Additionally, a pair of gloves is disclosed that is operable to be worn on the hands of a wearer. The gloves include a main body that define interior spaces operable to receive at least a portion of both hands of the wearer. The main bodies include a back area and a palm area, and a mirror is disposed on the palm area of at least one of the gloves.

Still further, a glove or a pair of gloves is disclosed that is operable to be worn on at least one hand of a wearer. The glove or pair of gloves includes a main body that defines an interior space that is operable to receive at least a portion of the at least one hand of the wearer. The glove or pair of gloves includes a mirror which has an integrated light source.

Still further, a glove or a pair of gloves is disclosed that is operable to be worn on at least one hand of a wearer. The glove or pair of gloves includes a main body that defines an interior space operable to receive at least a portion of the at least one hand of the wearer. The main body includes a palm area having an upper limit, a lower limit, an interior limit, an anterior limit, a longitudinal axis extending longitudinally through a point proximate the center of the palm area, and a distal palmar axis extending laterally and intersecting the longitudinal axis at a non-orthogonal angle. The longitudinal and distal palmar axes define four quadrants on the palm area, including a first quadrant comprising a portion of the interior and lower limits of the palm area. The glove or pair of gloves include at least one mirror having a center of area that is located entirely within the first quadrant of the palm area.

Still further, a glove or a pair of gloves is disclosed that is operable to be worn on at least one hand of a wearer. The glove or pair of gloves includes at least one removably attached mirror and at least one integrated wiper operable for cleaning or wiping the at least one mirror.

Further areas of applicability will become apparent from the description provided herein. The description and specific examples in this summary are intended for purposes of illustration only and are not intended to limit the scope of the present disclosure. Individual features of some examples described in this summary may be incorporated with other examples described in this summary without departing from the scope of the present disclosure.

DRAWINGS

The drawings described herein are for illustrative purposes of selected embodiments only and do not represent all possible implementations. These drawings are not intended to limit the scope of the present disclosure.

FIGS. 1A-1D are plan views of the front of a glove according to exemplary embodiments of the present disclosure.

FIGS. 2A-G are plan views of a mirror shapes according to exemplary embodiments of the present disclosure, demonstrating the location of a center of area for each shape.

DETAILED DESCRIPTION

Figure 2A:
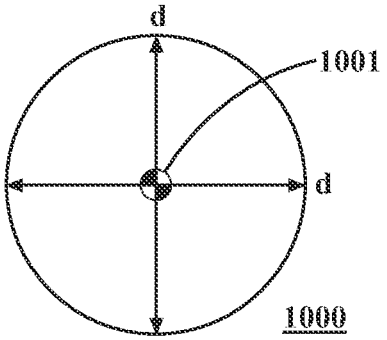

Example embodiments will now be described more fully with reference to the accompanying drawings.

Various glove configurations exist and may be operable with the inventive principles taught herein, for example the glove configurations shown in FIGS. 1A-1D.

As used herein to define spatial relationships with respect to a hand or a glove, the terms "interior" and "anterior" are used. An interior direction or side is defined as being on or towards the side of the hand or glove comprising the thumb. Similarly, an anterior direction or side is defined as opposite the interior direction or side of the hand or glove.

The term "mirror image" may be used herein to describe a correlation between two shapes, and generally refers to a substantially identical shape that is reflected about an axis, similar to how a person's right and left hands may be substantially mirror images of each other.

The term "center of area" is used herein and has the plain geometric meaning as is generally applied to two dimensional shapes when referring to a shape seen in plan view and may be calculated using known mathematical techniques. In addition to using known mathematical computational methods, one may readily find any two-dimensional or three-dimensional shape's center of area by reproducing the shape in 2D or 3D CAD or modeling software, for example AutoCAD, and having the software calculate the center of area of the shape.

FIG. 1A shows a glove 100 that fully covers each of a wearer's digits at digital coverings 110, 120, 130, 140 and 150. The glove 100 may have digital extremities 111, 121, 131, 141 and 151 that fully enclose each of a wearer's digits. The glove 100 may have a palm area 160, for covering a wearer's palm, and a back (not shown) for covering the back of the wearer's hand. At least a portion of the wearer's wrist and/or forearm to may be covered by the cuff 170 which provides a single opening 180 for receiving the wearer's hand. Optionally, the cuff 170 may terminate above the wrist.

FIG. 1B shows a partial glove 200 that covers at least a portion of each digit at digital coverings 210, 220, 230, 240 and 250 to provide at least 5 openings including an opening 280 at a cuff 270 and at digital openings 281, 282, 283, and 284. For example, the glove may have digital extremities 221, 231, 241, 251 that terminate near the proximal interphalangeal of each finger of a wearer to define the openings 281, 282, 283, 284 through which uncovered portions of a wearer's finger may protrude. The glove may have a digital extremity 211 that fully encloses a wearer's thumb. Optionally, the thumb digital covering 210 may have a digital extremity 211' that terminates near one of the wearer's thumb's phalangeal joints, e.g., the proximal interphalangeal joint, so as to provide a sixth opening 285. Any or all of each digital covering may terminate near a wearer's distal interphalangeal, proximal phalangeal, or metacarpophalangeal joint of the respective digit being covered, in any possible permutation.

FIG. 1C shows an embodiment of a glove 300 that has at least one digital covering 310 which may cover at least a portion of a wearer's thumb and at least one digital extremity 321 that terminates near the joints of each of a wearer's fingers, e.g., the metacarpophalangeal joints. The glove 300 has a palm area 350 covering a user's palm, and a cuff 370 defining a first opening 380 and a second opening 381 at the digital extremity 321. Optionally, the second opening 381 may be defined by a palmar extremity 351, such that the glove does not cover any portion of a wearer's fingers. The glove may have a second digital extremity 311 fully enclosing a wearer's thumb. Optionally, the glove 300 may have a second digital extremity 311' defining a third opening 382. The digital extremity 311' may terminate near one of the phalangeal joints of the thumb, e.g., the interphalangeal joint. This glove embodiment may be referred to by some as a brace or a sleeve.

FIG. 1D shows an embodiment of a glove 400 that has at least one opening 480 at a cuff 470, a palm area 450, and at least two digital coverings 410 and 420. A first digital extremity 411 may completely enclose a wearers thumb. Optionally, the first digital extremity 411' may provide a second opening through which a portion of a wearer's thumb may protrude, such that the digital covering 410 covers only a portion of a user's thumb. The second digital extremity 421 may enclose all of the wearer's fingers within the second digital covering 420. This embodiment may commonly be referred to as a mitten. Optionally, the first digital extremity 411' may terminate near one of the phalangeal joints of the thumb, e.g., the interphalangeal, to provide at least a second opening 481.

Many different mirror shapes may be advantageously incorporated to a glove in accordance with the inventive principles taught herein, including one or more of the examples described above. Each mirror shape may provide unique advantages, for example: increased comfort to the wearer; improved visibility; or aesthetic preference; or other advantages, alone or in combination. Several examples of possible mirror shapes which may be incorporated to a glove are described below.

FIG. 2A shows a first example of a mirror 1000 that has a generally circular shape when viewed in plan. The mirror 1000 has a center of area 1001 when viewed in plan that is located at the center of the circle. The mirror 1000 may have a major dimension that corresponds to the diameter of the circle, d.

Figure 2B:
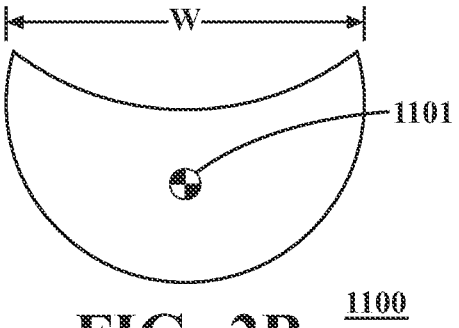

FIG. 2B shows a second example of a mirror 1100 that has a generally crescent shape when viewed in plan. The mirror has a center of area 1101 and a major dimension, w.

Figure 2C:
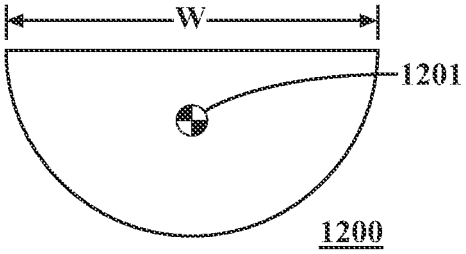

FIG. 2C shows a third example of a mirror 1200 that has a generally semi-circular shape when viewed in plan. The mirror 1200 has a center of area 1201 and a major dimension w.

Figure 2D:
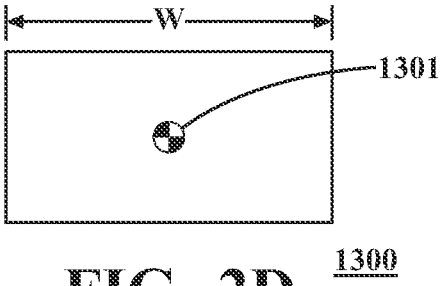

FIG. 2D shows a fourth example of a mirror 1300 that has a generally rectangular shape when viewed in plan. The mirror 1300 has a center of area 1301 that is generally located at center of the rectangle, and a major dimension w.

Figure 2E:
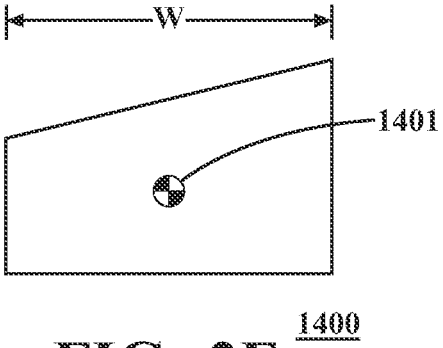

FIG. 2E shows a fifth example of a mirror 1400 that has a generally trapezoidal shape when viewed in plan. The mirror 1400 has a center of area 1401 and a major dimension w.

Figure 2F:
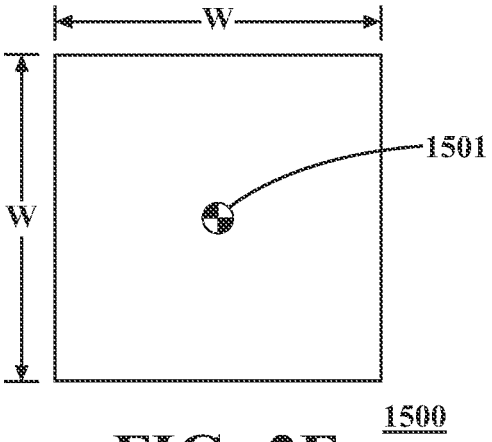

FIG. 2F shows a sixth example of a mirror 1500 that has a generally square shape when viewed in plan. The mirror has a center of area 1501 located at the center of the square, and a major dimension w.

Figure 2G:
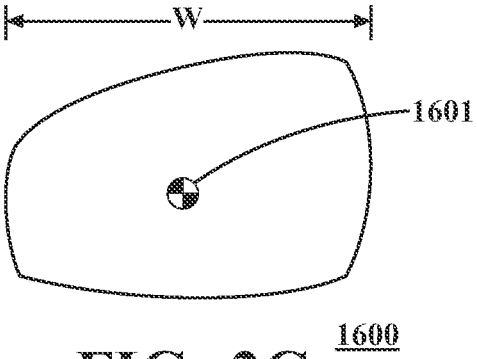

FIG. 2G shows a seventh example of a mirror 1600 that has a generally irregular or contoured shape when viewed in plan. The mirror 1600 has a center of area 1601 and a major dimension w.

In all examples, the size and shape of the mirror may correspond to a portion of the wearer's hand anatomy. In all examples, the mirrors may have a major dimension that ranges from approximately 1 to 3 inches. More preferably, the major dimension may range from about 1.5 to 2.5 inches. In another example, the mirror may have a major dimension that is about 2 inches. The major dimension may be defined as the largest projected height or width dimension of the mirror when placed on a glove, with reference to the longitudinal and lateral axes of a glove, respectively, as further described below. For example, on a circular mirror such as the mirror 1000 shown in FIG. 2A, the major dimension may correspond to the diameter d of the circle. In another example, such as the irregularly shaped mirror 1600 shown in FIG. 2G, the major dimension may correspond to the overall width w of the mirror 1600. In the example of the mirror 1500 shown in FIG. 2F, the major dimension w may correspond to either the height or the width of the square, since they are equal. However, if the mirror 1500 was oriented as a diamond (not shown), i.e., rotated several degrees about an axis perpendicular to the center of area of the square, the major dimension would be the largest of the two projected distances (longitudinal or lateral) between the corners of the "diamond".

Mirrors may be supplied in pairs, for example, to be placed on pairs of gloves. For irregular shapes, for example that are not symmetric, it may be appreciated that the pair of mirrors may be substantially identical but be their shapes may be substantially mirror images of each other. In other examples, mirrors may be supplied in pairs but have different shapes entirely, for example, one mirror may be round and the other may be square.

Figure 3:
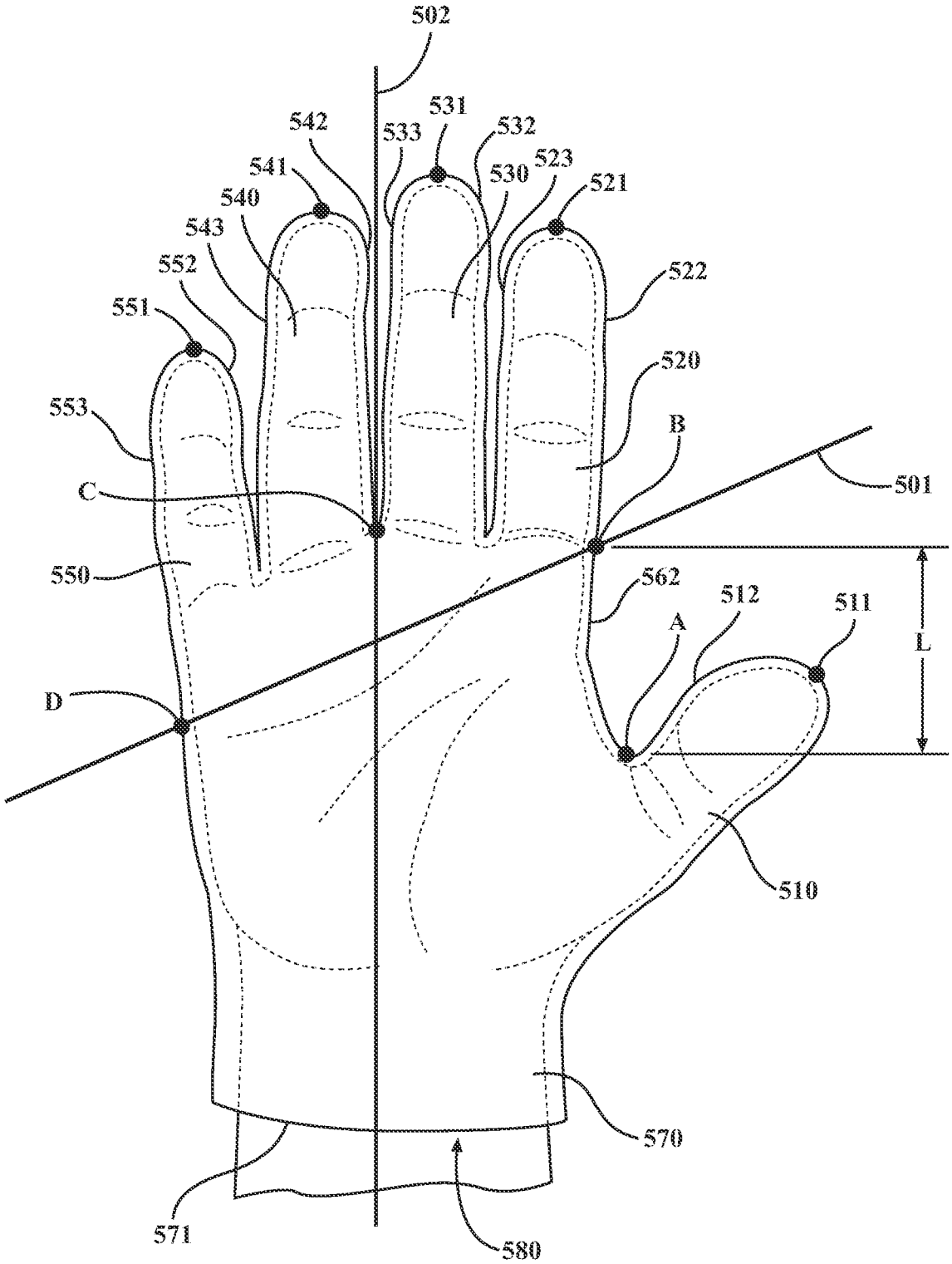
FIG. 3 is a plan view of a front of a glove according to exemplary embodiments of the present disclosure. The glove is shown in conjunction with a wearer's hand, and the portion of the wearer's hand contained within the glove is shown in phantom.
Figure 7:
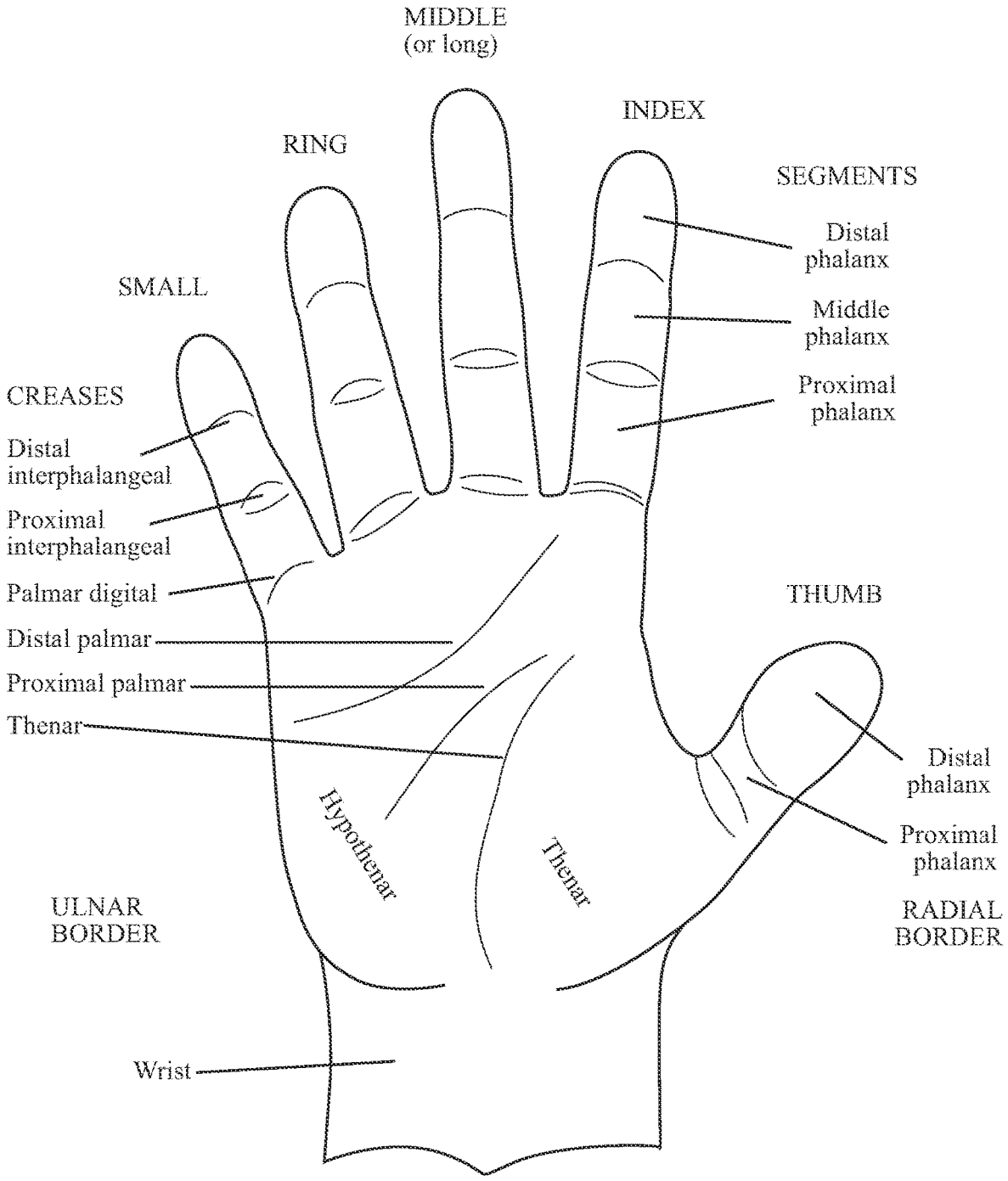
FIG. 7 is a depiction of a hand showing the anatomical portions of the hand as a reference to aid the understanding of the following description.

FIG. 3 shows an example of a glove 500, similar to the example of FIG. 1A, fitted to a wearer's hand. The hand is visible in phantom so as to enable a general visualization of the various portions of the hand's anatomy in relation to the glove, and a more detailed reference of the hand's anatomy is found in FIG. 7, for clarity of understanding.

The glove 500 may be segmented into various portions that may not necessarily have defined structural boundaries. Generally, the glove 500 may have a first axis 501 and second axis 502 that intersect to divide the glove into four quadrants. The first axis 501 may generally extend at least partially proximate to and along the general direction of the distal palmar crease of a wearer's hand (see FIG. 7). The second axis 502 may extend along the length of the wearer's hand (from the wrist to the fingertips), and located laterally between the ring and middle fingers. An axis defined in the manner of the second axis 502 may generally define the longitudinal direction of a given glove. An axis perpendicular to an axis defined in the manner of the second axis 502 may generally define the lateral direction of a given glove.

In one example, the axes 501, 502 may be determined without reference to a wearer's hand by laying the glove 500 on a flat surface, and viewing the glove perpendicular to the flat surface, as shown in FIG. 3. From this view, the glove may have a projected perimeter edge. The perimeter edge may be the projected outline of the glove 500 when positioned as described above. In this view, a longitudinal or lengthwise direction may be defined as being from a cuff 570 to the tips of finger digital coverings 520, 530, 540, 550, i.e., finger digital extremities 521, 531, 541, 551, and a lateral or widthwise direction may be defined as being generally perpendicular to the longitudinal direction. Various points may be determined along the perimeter edge which may be utilized to define the axes.

For example, the perimeter edge may comprise several segments extending between defined points, including digital extremities 511, 521, 531, 541, 551. A first segment 512 may extend along the edge of the thumb digital covering 510 from the thumb extremity 511 towards the interior edge of the palm area 560. A second segment 562 may extend along an interior edge of the palm area 560, below the index finger digital covering 520, and towards the first segment 512. A point A may be defined where the segments 512 and 562 meet, which may be the apex of a curve or the vertex of two substantially linear portions of the segments 512, 562. Similarly, a point B may be defined where the second segment 562 meets a third segment 522. The third segment 522 may be defined by the interior edge of the index digital covering 520, and may extend from the index extremity 521 to an upper limit of the palm area 560. If the upper limit of the palm area 550 is not clear, point B may be defined where the perimeter edge is intersected by a lateral axis extending through a point where a fourth segment 523 and a fifth segment 532 meet. The fourth segment 523 may comprise the anterior edge of the index digital covering 520, and may extend from the index extremity 521 towards the palm area 560. The fifth segment 532 may comprise the interior edge of the middle digital covering 530, and may extend from the middle extremity 531 towards the palm area 560. The fourth and fifth segments 523, 532 may meet at the apex of a curve or the vertex of two substantially linear portions of the segments 523, 532. A point C may be defined where a sixth segment 533 and a seventh segment 542 meet. The sixth segment 533 may comprise the anterior perimeter edge of the ring digital covering 530, and may extend from the ring extremity 531 towards the palm area 560. The seventh segment 542 may comprise the interior perimeter edge of the ring digital covering 540, and may extend from the ring extremity 541 towards the palm area 560. The intersection of the segments 533 and 542 may be the apex of a curve or the vertex of two substantially linear portions of the segments 533, 542. A point D may be defined as being located on an eight segment 553 comprising the anterior edge of the small digital covering 550 and palm area 560, and may extend from ring extremity 551 to an edge 571 of a cuff 570. The point D may be located at the intersection of the segment 553 and an axis extending laterally and located approximately (+/−10%) half the longitudinal distance L between points A and B.

In an embodiment where the glove is substantially without finger digital coverings, e.g., with reference to FIG. 1C in an example embodiment similar to glove 300, point C (not shown) may be defined at the midpoint of the upper edge 321 of the glove 300, which may substantially extend between interior palm edge 352 and anterior palm edge 353. Point B (not shown) may be substantially defined at the intersection of the interior palm edge 353 and the upper edge 321. Point D (not shown) may be defined at a point on the anterior edge 353 one half the longitudinal distance between a point A (defined as provided above in the example shown for the glove 500) and the point B (as provided above for the glove 300).

With the above points A, B, C, D defined, two axes 501, 502 may divide the glove into four quadrants as previously contemplated in reference to the wearer's hand, i.e., the first axis 501 may intersect points B and D and the second axis 502 may run longitudinally through the point C.

In some instances, it may be preferable to determine the quadrants of the glove with reference to the glove itself, which in turn may be used to locate the placement of a mirror onto the palm of the glove in accordance with the inventive principles of the contemplated technology described herein and without reference to a wearer's hand. The axes 501, 502 defined using this technique may not correspond exactly to the axes 501, 502 defined with reference to a user's hand since there are many different sizes and shapes of hands that may be inserted into any glove design. Therefore, this technique may be a preferred method of defining the axes 501, 502 when a generic hand has not been defined. Should there be confusion over which method should be used to define the axes, and as a result to define the placement of the mirror on the glove in some example embodiments of this disclosure, the choice may be governed by the method used to design the glove and/or the availability of a defined hand. If a known hand defines the shape and geometry of a given glove design, e.g., a bespoke design or one designed using a defined hand (e.g., a hand model), then the technique referencing the wearer's hand should govern if the defined hand or a facsimile (e.g., a 3D rendering) is readily available as a reference to define quadrants of that glove. Conversely, if the shape and geometry of a glove is designed using, e.g., a predefined set of parameters for glove sizing or some other method, or if quadrants cannot be readily determined using a defined hand or a facsimile, then the method of defining the quadrants with reference to the glove itself should govern.

Figure 8:
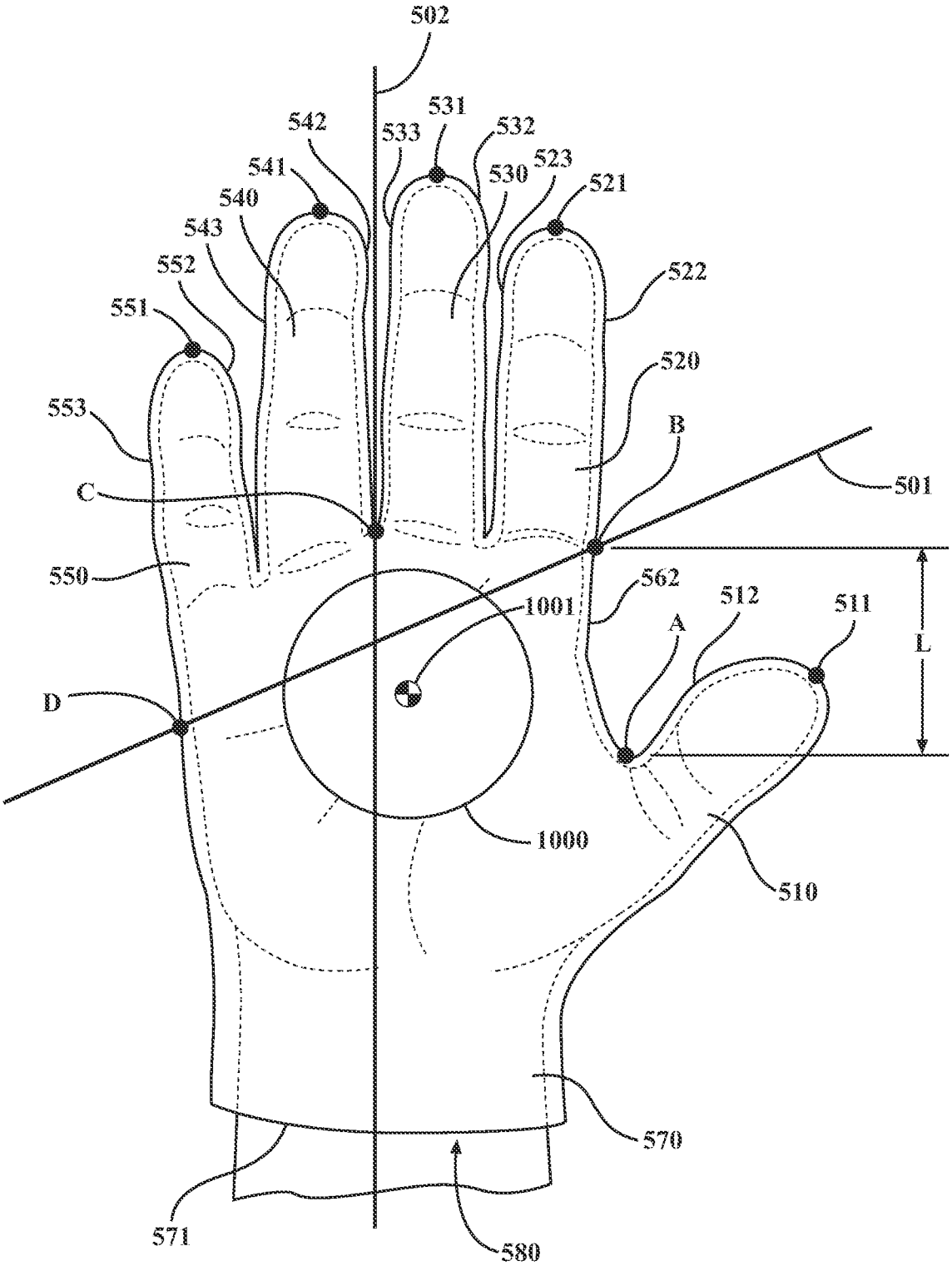
FIG. 8 is a plan view of a front of a glove according to exemplary embodiments of the present disclosure and with the mirror of FIG. 2A attached to the glove. The glove is shown in conjunction with a wearer's hand, and the portion of the wearer's hand contained within the glove is shown in phantom.

In order to ensure comfort for the wearer, as well as adequate mobility and function of the wearer's hand, e.g. to grasp an object, in some embodiments it may be preferable to locate the center of area of the mirror in the quadrant that contains the thumb digital covering, as shown in FIG. 8 in which the various features have been described in FIG. 3 and FIG. 2A. In conjunction with the range of mirror sizes and shapes disclosed above, a wearer may achieve maximum benefit of the embodiments disclosed herein, i.e., the ability to see what is behind them while still having adequate use of their hand for typical tasks. By simply lifting their hand into a position where their palm is visible and the mirror reflects an area behind them, the wearer may benefit from greater security and safety. One example of a specific use that provided particular advantages was for wearers engaged in physical activities, e.g., running. A glove having a mirror located according to the above principles eliminated the need for the wearer to turn their head while running to see what was behind them, eliminating the risk of collisions while providing the sense of security of knowing what was behind them at any given moment.

Figure 4:
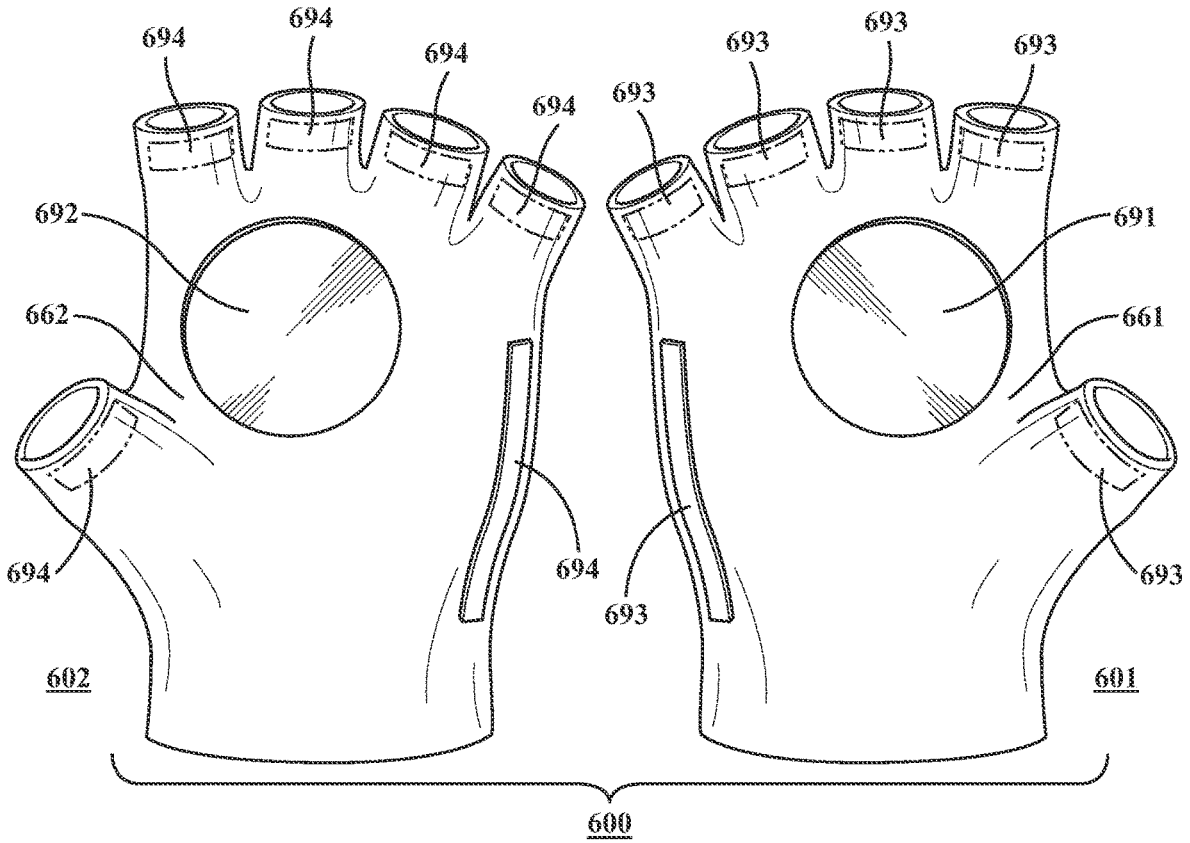
FIG. 4 is a plan view of a pair of gloves according to exemplary embodiments of the present disclosure with a mirror attached to the surface of a palm area on each glove.

FIG. 4 shows an embodiment of a pair of gloves 600, each glove 601, 602 fitted with a mirror 691, 692 on the palm areas 661, 662 in accordance with the inventive principles contained in this disclosure. In this example, the mirrors 691, 692 are round and the glove has openings in each digital covering. It should be appreciated that any glove configuration or mirror shape may be utilized, such as those described in detail above, and that this embodiment is shown by way of example only.

In some embodiments, also as shown in FIG. 4, either or both of the gloves 601 or 602 may be provided with wipers 693, 694 for cleaning the mirrors 691, 692. The wipers 693, 694 may be made from an absorbent material that will not scratch the mirror, but that capable to wipe fog, condensation, liquids or detritus from the mirror by the wearer. An example material may be one of a microfiber textile and a terry cloth, e.g., made of a natural fiber such as cotton, hemp, silk or the like, or a synthetic fiber such as a polyester, nylon, rayon, or the like. Alternatively, the wipers 693, 694 may be made from a soft plastic or elastomeric material, such as a TPU, Silicone, EPDM Rubber and the like. The wipers 693, 694 may be made from an expanded material, for example an open or closed cell foam. For example, the wipers may be made from a foamed silicone, polyurethane (thermoset or thermoplastic), ethylene-vinyl acetate (EVA) or a natural or synthetic foam rubber such as neoprene (i.e., polychloroprene) or latex. Regardless of the choice of material used for the wipers 693, 694, various examples of placement locations are demonstrated in FIG. 4, such as at the anterior edge of the palm areas 661, 662 and at the base of each digital covering. It should be appreciated that the wipers may be located anywhere on a glove that provides the user with a convenient ability to wipe a mirror.

In some embodiments, a mirror may be provided on only one glove, and a wiper or multiple wipers may be provided on the other glove (if a pair of gloves is being provided to a wearer). Optionally, both gloves of a pair may have wipers and removable attachment features described below, but only one mirror may be supplied to the wearer. Similarly, a glove or a pair of gloves may be provided with attachment features and/or wipers thereon, and a mirror with complimentary attachment features may be provided separately. It may be advantageous for a provider to supply a range of options for various wearers, e.g., different mirror shapes and/or sizes and/or types (e.g. convex, flat, etc.).

Figure 5:
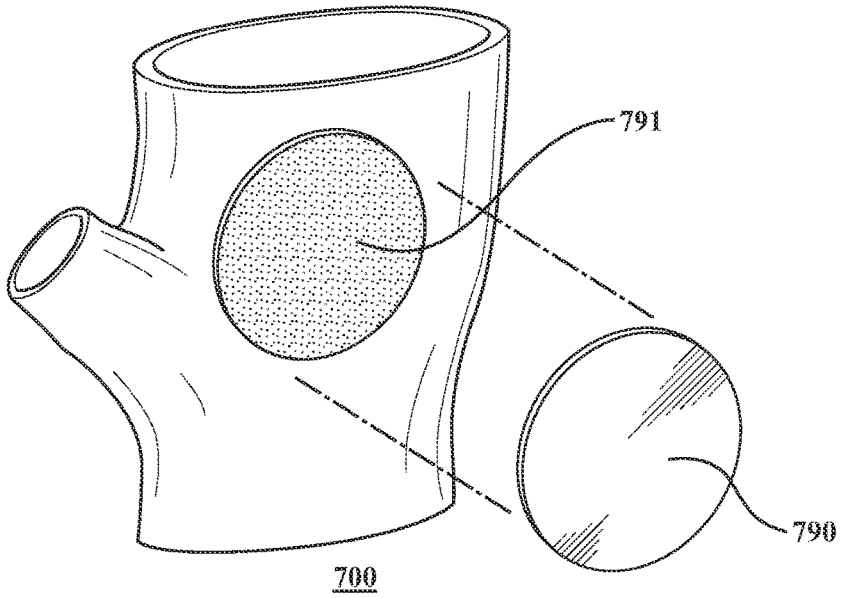
FIG. 5 is an exploded perspective view of one of the gloves of FIG. 4.

In some embodiments, as shown in FIG. 5, a mirror 790 may optionally be removably attached to a glove 700, e.g., to enable the glove to be machine washed without damaging the mirror 790 or, e.g., to allow a wearer to fit a different mirror (not shown) should they wish to have a different mirror configuration (e.g., shape, size, or type) or should they need to replace a cracked or broken mirror. The mirror 790 may have a hook or loop fabric adhered to its rear surface (not shown), and the glove 700 may have the other of a hook or loop fabric 791 adhered to it. Alternatively, the mirror 790 and the glove 700 may have magnets and/or ferromagnetic materials adhered to them to achieve similar removable attachment. Adhering of the fabric or magnetic/ferromagnetic materials may be achieved by known methods such as using adhesives, sewing, co-molding, use of heat and pressure (if one of the glove, mirror and fabrics or magnets comprises a thermoplastic material), as well as other known methods for adhering materials. In another example, the mirror and glove may incorporate a snap system to snap the mirror onto the glove (not shown) as is commonly known to one of ordinary skill in the art.

Figure 6A:
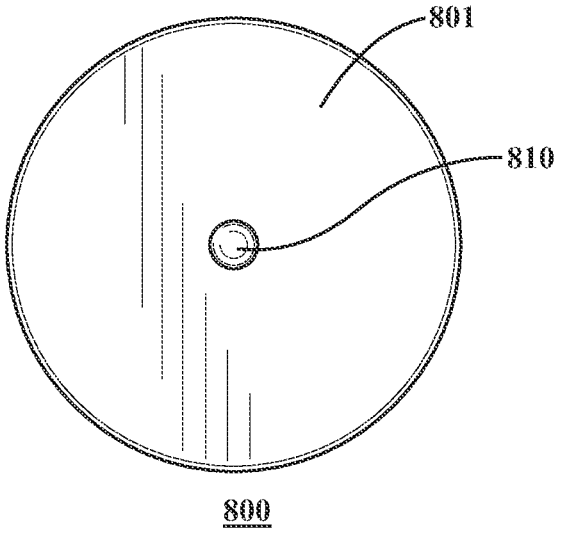
FIG. 6A is a plan view of the front of a mirror according to exemplary embodiments of the present disclosure, wherein the mirror incorporates a light source.
Figure 6B:
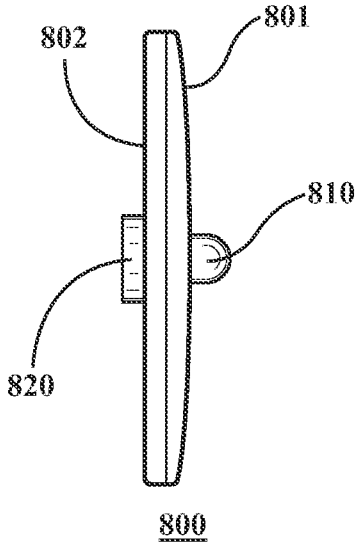
FIG. 6B is a side view of the mirror of FIG. 6A.
Figure 6C:
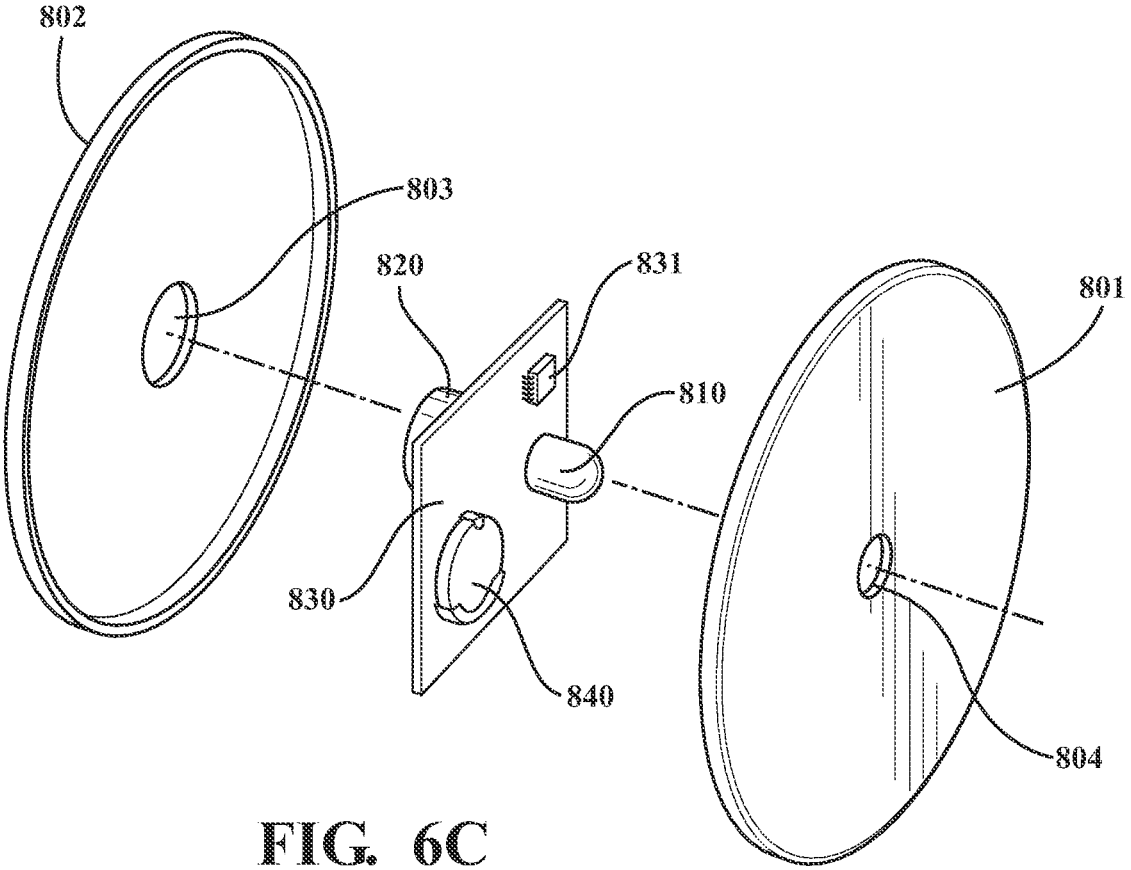
FIG. 6C is an exploded perspective view of the mirror of FIGS. 6A and 6B, showing internal components of the light source.

In another embodiment, for example as shown in FIGS. 6A-6C, a mirror 800 may be provided for attachment to a glove (not shown) comprising a light source 810. The light source 810 may be powered by a power supply 840. The power supply 840 may be a battery. The battery 840 may be of a size and type necessary to power the selected type and size of the light source 810, as is well known by those skilled in the art of circuit design and manufacturing. The light source 810 may, e.g., be a light emitting diode. The light source 810 may, e.g., be a color changing LED (or a red, a blue, and a green LED in one casing). The light source 810 may attached to a circuit board 830 comprising a button 820, at least one controller 831, and the power source 840 such as a battery. The at least one controller 831 may be an LED driver. The at least one controller 831 may operatively control the light source 810, for example, by controlling the current supplied to the LED or to the individually colored LED's of a color changing LED, so as to, e.g., control the brightness of the light source and/or the color generated by the light source 810, and/or a pattern, e.g., a blinking pattern, of light generation produced by the light source 810. The at least one controller 831 may comprise for wireless connectivity to a personal computing device, such as a smartphone, to operatively control functions of the light source 810 (e.g., using Bluetooth connectivity or similar protocols). A detailed description is not provided herein of the possible controllers that may be utilized to operatively control the light source 810 since they are well known in the art and easily integrated into a light source assembly using well-known techniques and readily available components.

It may be advantageous for the button 820 to be located at or protrude from the rear surface 802 of the mirror 800, or may extend through an aperture 803 in the back surface 802 of the mirror, such that in use the light source 810 may be activated by pressing on the mirror 800. Thereby, the light source 810 may be activated using the resulting reaction pressure supplied by a wearer's hand within the glove (not shown) to the button 820 on the rear side 802 of the mirror. A front surface 801 of the mirror may be provided with an aperture 804 through which the light source 810 may protrude, or alternatively, such that light source 810 within the mirror 800 may be in communication with the surroundings and thereby illuminate the surroundings.

In all embodiments, the mirror may be made from a plastic material with a mirrored coating which is well known in the art of mirror manufacturing. In all embodiments, the mirror surface may be substantially flat, or the mirror surface may have concavity or convexity, e.g., to provide a wider range of view or to magnify the reflected view for the wearer. If the mirror is provided with concavity, the concavity would generally be mild so as to substantially maintain at least a usable viewing range to the wearer. In any case, the concavity supplied to the mirror would be much less pronounced than the concavity typically supplied for a flashlight reflector which is intended to focus the light emitted from a light source. Reflectors of flashlights with concave mirrored surfaces are not operable for use as mirrors, since they produce a reflected field of view that would not be operable in use with the intended mirror functionality required to practice the inventive principles taught herein.

As previously mentioned, the mirror may be attached directly to the glove(s), for example by gluing or otherwise adhering it directly to the glove. Alternatively, the mirror may indirectly attached, e.g., by gluing or otherwise adhering the mirror to a piece of material having a shape and/or size such that the piece of material may extend beyond at least a portion of the mirror's edge. As such, that the piece of material may be stitched, seam-welded or otherwise attached to the glove.

The following Clauses provide an exemplary configuration for a glove configured with a mirror and additional features.

Clause 1: A pair of gloves, comprising a first and second glove, each glove comprising: a main body including an opening operable to receive at least a portion of a hand and an interior space in communication with the opening, the main body including a back area and a palm area, the palm area having an upper limit, a lower limit, an interior limit, an anterior limit, a longitudinal axis extending longitudinally through a point proximate the center of the palm area, a distal palmar axis extending laterally and intersecting the longitudinal axis at a non-orthogonal angle, at least a portion of the distal axis located proximate the upper limit of the palm area, the longitudinal and distal palmar axes defining four quadrants on the palm area including a first quadrant comprising a portion of the interior and lower limits; and a first mirror coupled to the palm area of the first glove, the first mirror having a first center of area; wherein the first center of area is located entirely within the first quadrant of the first glove.

Clause 2: The pair of gloves of clause 1 wherein the mirror is removably coupled to the main body of the first glove.

Clause 3: The pair of gloves of clause 2 wherein hook and loop fasteners are used to removably couple the mirror to the main body of the first glove, such that the mirror comprises one of loops or hooks and the main body of the first glove comprises the other of loops or hooks.

Clause 4: The pair of gloves of clause 3 wherein the second glove has the other of loops or hooks, such that the first mirror may be removably coupled to the second glove with the center of area located entirely within the first quadrant of the second glove.

Clause 5: The pair of gloves of clause 1 wherein the mirror has a major dimension between about 1.5 inches and about 3 inches.

Clause 6: The pair of gloves of clause 1 wherein the mirror has a major dimension between about 1.75 inches and about 2.25 inches.

Clause 7: The pair of gloves of clause 1, wherein at least the second glove comprises a wiper configured to wipe the mirror.

Clause 8: The pair of gloves of any of clauses 1-7 comprising a second mirror, the second mirror having a second center of area and being coupled to the second glove, wherein the second center of area is located entirely within the first quadrant of the second glove.

Clause 9: The pair of gloves of any of clauses 1-8 wherein at least the first mirror comprises a light source.

Clause 10: The pair of gloves of clause 9 wherein the light source is a light emitting diode.

Clause 11: The pair of gloves of clause 9 wherein the light source comprises a power source and a switching component for operatively enabling the light source.

Clause 12: The pair of gloves of clause 11 wherein the switching component is a button.

Clause 13: The pair of gloves of clause 12 wherein the mirror has a rear surface, and the button is located on the rear surface of the mirror.

Clause 14: The pair of gloves of any of clauses 9-13 wherein the mirror comprises a controller, the controller operatively controlling the light source.

Clause 15: The pair of gloves of any of clauses 1-9 wherein at least the first mirror is convex.

Clause 16: The pair of gloves of any of clauses 1-9 wherein at least the first mirror is concave.

Clause 17: The pair of gloves of either of clauses 10 or 11 wherein the second mirror has the same configuration as the first mirror, wherein the first mirror has a first shape, and the second mirror has a shape that is a mirror image of the first shape.

Clause 18: A glove comprising: a main body including an opening operable to receive at least a portion of a hand and an interior space in communication with the opening, the main body including a back area and a palm area, the palm area having an upper limit, a lower limit, an interior limit, an anterior limit, a longitudinal axis extending longitudinally through a point proximate the center of the palm area, a distal palmar axis extending laterally and intersecting the longitudinal axis at a non-orthogonal angle, at least a portion of the distal axis located proximate the upper limit of the palm area, the longitudinal and distal palmar axes defining four quadrants on the palm area including a first quadrant comprising a portion of the interior and lower limits; and a mirror coupled to the palm area of the glove, the mirror having a center of area; wherein the center of area is located entirely within the first quadrant of the glove.

Clause 19: The glove of clause 18 wherein the mirror is removably coupled to the main body of the glove.

Clause 20: The glove of clause 19 wherein hook and loop fasteners are used to removably couple the mirror to the main body of the glove, such that the mirror comprises one of loops or hooks and the main body of the glove comprises the other of loops or hooks.

Clause 21: The glove of clause 18 wherein the mirror has a major dimension between about 1.5 inches and about 3 inches.

Clause 22: The glove of clause 18 wherein the mirror has a major dimension between about 1.75 inches and about 2.25 inches.

Clause 23: The glove of any of clauses 18-22 wherein the mirror comprises a light source.

Clause 24: The glove of clause 23 wherein the light source is a light emitting diode.

Clause 25: The glove of clause 23 wherein the light source comprises a power source and a switching component for operatively enabling the light source.

Clause 26: The glove of clause 25 wherein the switching component is a button.

Clause 27: The glove of clause 26 wherein the mirror has a rear surface, and the button is located on the rear surface of the mirror.

Clause 28: The glove of any of clauses 23-27 wherein the mirror comprises a controller, the controller operatively controlling the light source.

Clause 29: The glove of any of clauses 18-28 wherein the mirror is convex.

Clause 30: The glove of any of clauses 18-28 wherein the mirror is concave.

Clause 31: The glove of any of clauses 18-28 wherein the glove includes a wiper configured to wipe the mirror.

Clause 32: A glove comprising: a main body including an opening operable to receive at least a portion of a hand and an interior space in communication with the opening, the main body including a back area and a palm area, the palm area having an upper limit, a lower limit, an interior limit, an anterior limit; and a mirror coupled to the palm area of the glove, and wherein the mirror comprises a light source.

Clause 33: The glove of clause 32 wherein the glove comprises: a longitudinal axis extending longitudinally through a point proximate the center of the palm area, a distal palmar axis extending laterally and intersecting the longitudinal axis at a non-orthogonal angle, at least a portion of the distal axis located proximate the upper limit of the palm area, the longitudinal and distal palmar axes defining four quadrants on the palm area including a first quadrant comprising a portion of the interior and lower limits; and the mirror having a center of area; wherein the center of area is located entirely within the first quadrant of the glove.

Clause 34: The glove of one of clauses 32 and 33 wherein the mirror is removably coupled to the main body of the glove.

Clause 35: The glove of clause 34 wherein hook and loop fasteners are used to removably couple the mirror to the main body of the glove, such that the mirror comprises one of loops or hooks and the main body of the glove comprises the other of loops or hooks.

Clause 36: The glove of one of clauses 32 and 33 wherein the mirror has a major dimension between about 1.5 inches and about 3 inches.

Clause 37: The glove one of clauses 32 and 33 wherein the mirror has a major dimension between about 1.75 inches and about 2.25 inches.

Clause 38: The glove of any of clauses 32-37 wherein the mirror comprises a light source.

Clause 39: The glove of clause 38 wherein the light source is a light emitting diode.

Clause 40: The glove of clause 38 wherein the light source comprises a power source and a switching component for operatively enabling the light source.

Clause 41: The glove of clause 40 wherein the switching component is a button.

Clause 42: The glove of clause 41 wherein the mirror has a rear surface, and the button is located on the rear surface of the mirror.

Clause 43: The glove of any of clauses 38-42 wherein the mirror comprises a controller, the controller operatively controlling the light source.

Clause 44: The glove of any of clauses 32-43 wherein the mirror is convex.

Clause 45: The glove of any of clauses 32-43 wherein the mirror is concave.

Clause 46: The glove of clause 32 wherein the glove includes a wiper configured to wipe the mirror.

Clause 47: A glove comprising: a main body including an opening operable to receive at least a portion of a hand and an interior space in communication with the opening, the main body including a back area and a palm area, the palm area having an upper limit, a lower limit, an interior limit, an anterior limit; and a mirror coupled to the palm area of the glove, the mirror having a perimeter shape; and wherein the perimeter shape of the mirror is located entirely within the palm area of the glove.

Clause 48: The glove of clause 45 wherein the mirror is removably coupled to the main body of the glove.

Clause 49: The glove of clause 46 wherein hook and loop fasteners are used to removably couple the mirror to the main body of the glove, such that the mirror comprises one of loops or hooks and the main body of the glove comprises the other of loops or hooks.

Clause 50: The glove of one of clauses 45-47 wherein the mirror has a major dimension between about 1.5 inches and about 3 inches.

Clause 51: The glove one of clauses 45-47 wherein the mirror has a major dimension between about 1.75 inches and about 2.25 inches.

Clause 52: The glove of any of clauses 45-49 wherein the mirror comprises a light source.

Clause 53: The glove of clause 50 wherein the light source is a light emitting diode.

Clause 54: The glove of clause 50 wherein the light source comprises a power source and a switching component for operatively enabling the light source.

Clause 55: The glove of clause 52 wherein the switching component is a button.

Clause 56: The glove of clause 53 wherein the mirror has a rear surface, and the button is located on the rear surface of the mirror.

Clause 57: The glove of any of clauses 50-54 wherein the mirror comprises a controller, the controller operatively controlling the light source.

Clause 58: The glove of any of clauses 45-54 wherein the mirror is convex.

Clause 59: The glove of any of clauses 45-54 wherein the mirror is concave.

Clause 60: The glove of clause 47 wherein the glove includes a wiper configured to wipe the mirror.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A pair of gloves, comprising a first and second glove, each glove comprising:

a main body including:

an opening operable to receive at least a portion of a hand of a wearer, the hand having a palm, a thumb, an index finger, a middle finger, a ring finger and a small finger;

an interior space in communication with the opening;

a back area;

a palm area, the palm area configured to correspond to the palm of the hand and having an upper limit, a lower limit configured to be located above a wrist of the wearer, an interior limit, an anterior limit, a longitudinal axis extending longitudinally through a point on the upper limit configured to be located between the ring finger and the middle finger of the hand, a distal palmar axis extending laterally and intersecting the longitudinal axis at a non-orthogonal angle and intersecting the upper limit of the palm area, the longitudinal and distal palmar axes defining four quadrants on the palm area including a first quadrant comprising a portion of the interior and lower limits; and a first mirror attached to the palm area of the first glove, the first mirror having a first center of area;

wherein the first center of area is located entirely within the first quadrant of the first glove.

2. The pair of gloves of claim 1 wherein the first mirror is removably attached to the main body of the first glove.

3. The pair of gloves of claim 2 wherein hook and loop fasteners are used to removably attach the first mirror to the main body of the first glove, such that the first mirror comprises one of loops or hooks and the main body of the first glove comprises the other of loops or hooks.

4. The pair of gloves of claim 3 wherein the second glove has the other of loops or hooks, such that the first mirror may be removably attached to the second glove with the center of area located entirely within the first quadrant of the second glove.

5. The pair of gloves of claim 1 wherein the first mirror has a major dimension between about 1.5 inches and about 3 inches.

6. The pair of gloves of claim 1, wherein at least the second glove comprises a wiper configured to wipe the first mirror.

7. The pair of gloves of claim 3 comprising a second mirror, the second mirror having a second center of area and being coupled to the second glove and the second center of area is located entirely within the first quadrant of the second glove, wherein hook and loop fasteners are used to removably attach the second mirror to the main body of the second glove, such that the second mirror comprises one of loops or hooks and the main body of the second glove comprises the other of loops or hooks.

8. The pair of gloves of claim 7 wherein the second mirror has a similar configuration to the first mirror and the first mirror has a first shape, the second mirror has a second shape wherein the second shape is a mirror image of the first shape.

9. A glove comprising:

a main body including:

an opening operable to receive at least a portion of a hand of a wearer, the hand having a palm, a thumb, an index finger, a middle finger, a ring finger and a small finger;

an interior space in communication with the opening;

a back area;

a palm area, the palm area configured to correspond to the palm of the hand and having an upper limit, a lower limit configured to be located above a wrist of the wearer, an interior limit, an anterior limit, a longitudinal axis extending longitudinally through a point on the upper limit configured to be located between the ring finger and the middle finger of the hand, a distal palmar axis extending laterally and intersecting the longitudinal axis at a non-orthogonal angle and intersecting the upper limit of the palm area, the longitudinal and distal palmar axes defining four quadrants on the palm area including a first quadrant comprising a portion of the interior and lower limits; and a mirror attached to the palm area of the glove, the mirror having a center of area;

wherein the center of area is located entirely within the first quadrant of the glove.

10. The glove of claim 9 wherein the mirror is removably attached to the main body of the glove.

11. The glove of claim 10 wherein hook and loop fasteners are used to removably attach the mirror to the main body of the glove, such that the mirror comprises one of loops or hooks and the main body of the glove comprises the other of loops or hooks.

12. The glove of claim 9 wherein the mirror has a major dimension between about 1.5 inches and about 3 inches.

13. The glove of claim 9 wherein the mirror comprises a light source, the light source comprising at least one light emitting diode, a power source, and a controller for operatively controlling the light source.

14. The glove of claim 13, wherein the mirror comprises a rear surface and a switching component for operatively enabling the light source, the switching component is a button, and the button is located at the rear surface.

15. The glove of claim 9 wherein the glove includes a wiper configured to wipe the mirror.

16. A glove comprising:

a main body including:

an opening operable to receive at least a portion of a hand of a wearer, the hand having a palm, a thumb, an index finger, a middle finger, a ring finger and a small finger;

an interior space in communication with the opening;

a back area;

a palm area, the palm area configured to correspond to the palm of the hand and having an upper limit, a lower limit configured to be located above a wrist of the wearer, an interior limit, an anterior limit; and a longitudinal axis extending longitudinally through a point on the upper limit configured to be located between the ring finger and the middle finger of the hand, a distal palmar axis extending laterally and intersecting the longitudinal axis at a non-orthogonal angle and intersecting the upper limit of the palm area, the longitudinal and distal palmar axes defining four quadrants on the palm area including a first quadrant comprising a portion of the interior and lower limits; and the mirror having a center of area;

wherein the center of area is located entirely within the first quadrant of the glove.

17. The glove of claim 16 wherein the mirror is removably attached to the main body of the glove.

18. The glove of claim 16 wherein the glove includes a wiper configured to wipe the mirror.

19. The glove of claim 16 wherein the light source comprises at least one light emitting diode, a power source, a controller for operatively controlling the light source.

20. The glove of claim 19, wherein the mirror comprises a rear surface and a switching component, the switching component operatively enabling the light source, wherein the switching component is a button located at the rear surface of the mirror.

* * * * *